US005937445A

United States Patent [19]

Ravo et al.

[11] Patent Number: 5,937,445

[45] Date of Patent: Aug. 17, 1999

[54] ONE-PIECE SURGICAL MASK AND CAP

[76] Inventors: Biagio Ravo, Rome American Hospital, Via Emilio Longoni, 69 - Rome, Italy, 00155; Enrico Nicolo, 1515 Timberlane, Clairton, Pa. 15025

[21] Appl. No.: 08/969,782

[22] Filed: Nov. 13, 1997

Related U.S. Application Data

[60] Provisional application No. 60/030,544, Nov. 13, 1996.

[51] Int. Cl.[6] ..... A42B 1/04

[52] U.S. Cl. ..... 2/173; 2/9; 2/206; 2/901; 128/201.24; 128/206.19; 128/206.23

[58] Field of Search ..... 2/9, 171, 173, 2/206, 901, 424; 128/857, 858, 206.12, 206.19, 201.12, 201.17, 201.24, 206.23

[56] References Cited

U.S. PATENT DOCUMENTS

| | | | |
|---|---|---|---|
| 1,990,200 | 2/1935 | Nemzek | 2/206 |
| 2,752,916 | 7/1956 | Haliczer | 2/206 |
| 3,314,079 | 4/1967 | Stout et al. . | |
| 3,885,558 | 5/1975 | Belkin | 128/142.7 |
| 4,032,991 | 7/1977 | Vandeweghe | 2/173 |
| 4,067,069 | 1/1978 | Slosek et al. | 2/441 |
| 4,589,408 | 5/1986 | Singer | 128/132 R |
| 4,662,005 | 5/1987 | Grier-Idris | 2/9 |
| 5,067,174 | 11/1991 | Ritchey et al. | 2/10 |
| 5,099,525 | 3/1992 | Millauro | 2/9 |
| 5,269,024 | 12/1993 | Wyatt | 2/173 |
| 5,446,925 | 9/1995 | Baker et al. | 2/9 |

*Primary Examiner*—Diana L. Oleksa
*Attorney, Agent, or Firm*—Webb Ziesenheim Logsdon Orkin & Hanson, P.C.

[57] ABSTRACT

The one-piece surgical mask and cap includes a substantially planar blank with an eye opening formed therethrough. Straps are attached to the side edges of the blank for connecting the one-piece surgical mask and cap to the user. The upper portion of the blank above the eye opening forms the cap portion, and the lower portion of the blank below the eye opening forms the mask portion. Elastic bands may be provided surrounding the eye opening to further secure the one-piece surgical mask and cap of the present invention to the user.

18 Claims, 2 Drawing Sheets

ONE-PIECE SURGICAL MASK AND CAP

The present application claims the benefit of Provisional Application Serial No. 60/030,544 entitled "One-Piece Surgical Mask And Cap", filed on Nov. 13, 1996.

BACKGROUND OF THE INVENTION

1. Field of the Invention

We, Biagio Ravo and Enrico Nicolo, have invented improvements relating to a surgical mask and cap combination. More specifically, our invention relates to an easily manufacturable, disposable one-piece surgical mask and cap.

2. Prior Art

Physicians, nurses and other practitioners working in hospitals and other health-care facilities have worn sterilized apparel, most commonly over top of normal apparel. In general, sterilized paper and other materials which are disposable and biodegradable have been utilized for constructing these garments. A wide variety of garments has been designed and proposed for covering the head and face of health-care professionals. Such garments generally include a cap for covering the hair adjacent the head area in combination with a separate mask tied around the back of the user's head.

Although widely used, the separate head piece and mask results in undesirable hygiene practices in an operating room environment. Specifically, practitioners should change both the cap and mask between operations or sessions to prevent cross-contamination. Often, however, practitioners will only change the mask maintaining the same cap through several sessions or operations. This practice increases the risk to the patient and should be avoided.

A variety of devices has also been proposed for forming the mask and cap in one-piece configurations, such as described in U.S. Pat. Nos. 4,589,408 and 5,269,024. U.S. Pat. No. 3,885,558 additionally discloses a complete head covering for use in sterile environments. The problem with these prior art designs is that they are formed of relatively complicated shapes which adversely affect the manufacture and user acceptance of these devices. A separate issue is providing a one-piece structure which guarantees head and mouth coverage and also accommodates longer hair. Another issue is providing a one-piece mask and cap which provides eye protection and/or can easily accommodate corrective lenses for the user.

An object of our invention is to overcome the aforementioned drawbacks of the applied prior art. It is a further object of our invention to provide a one-piece, disposable surgical mask and cap which is easily manufactured, stored and used.

SUMMARY OF THE INVENTION

The objects of our invention are achieved by providing a sterilizable one-piece surgical mask and cap formed of a substantially rectangular blank. An eye opening is formed in the rectangular blank material wherein the portion of the rectangular blank below the eye opening forms the mask portion, and the portion of the rectangular blank above the eye opening forms the cap portion. The mask and cap portions of the rectangular blank are attached to each other by connecting portions of the rectangular blank on opposite sides of the eye opening. At least one strap may be provided on the sides of the rectangular blank to secure the one-piece surgical mask and cap to the user's head. The one-piece surgical mask and cap may further include elastic around the eye opening and/or along the sides or other selected portions to conform the surgical mask and cap to the user.

A second embodiment of our invention modifies the rectangular blank arrangement of the first embodiment by having the side edges of the blank taper outwardly in the cap portion above the eye opening to provide a wider cap portion. In all other respects, the second embodiment is substantially the same as the first embodiment of our invention.

A further embodiment of our invention further modifies the rectangular blank of the first embodiment to better conform to the users head. However, the one-piece surgical mask and cap of this further embodiment is still formed out of a substantially flat or planar blank of material to improve manufacturability and storage of the device. A clear eye shield may be provided over the eye opening. The eye shield may be constructed as a corrective lens and be removably attached to the blank of material. Perspiration absorbent material may be provided at selected portions on the blank of material, such as over the eye opening. A nose piece formed as a deformable metal strip may be attached to the blank of material below the eye opening for conforming the one piece surgical mask and cap to the user's face. Additionally, the blank of material may include a plurality of accordion type folds at a lower end thereof to help form a pocket around the user's chin and mouth when in use.

These and other advantages of our invention will be clarified in the brief description of the preferred embodiments taken together with the attached figures, wherein like reference numerals represent like elements throughout.

BRIEF DESCRIPTION OF THE PREFERRED EMBODIMENTS

Figure 1:
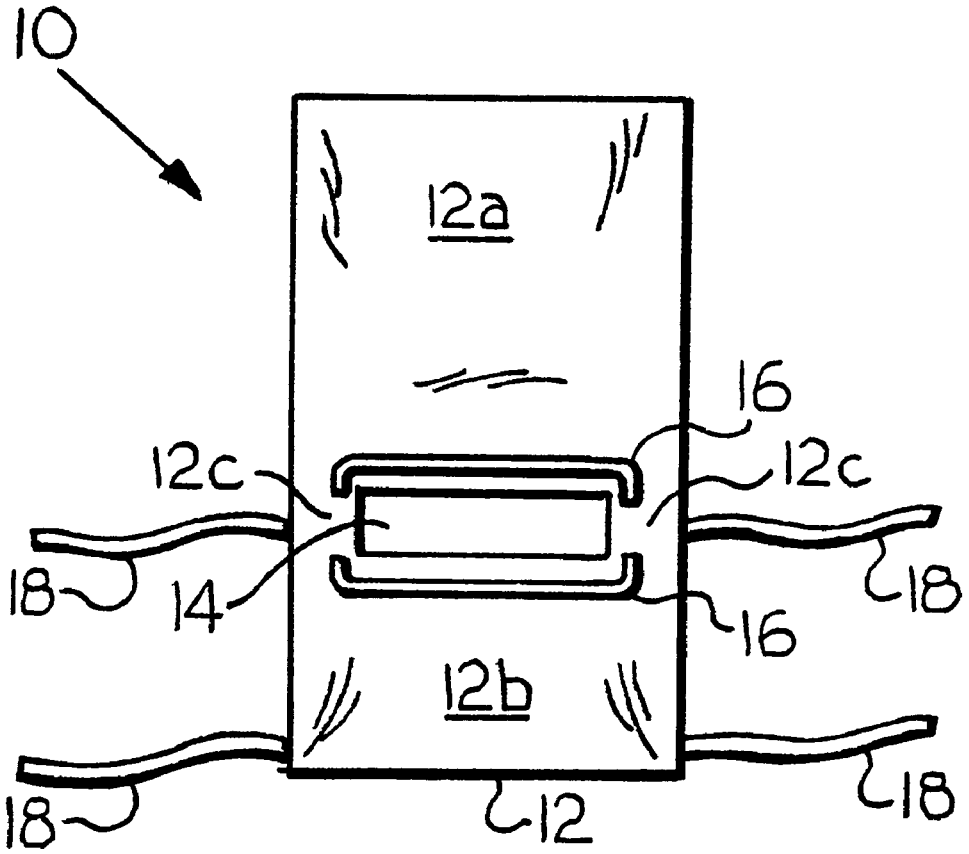
FIG. 1 is a plan view of a one-piece surgical mask and cap combination according to our invention.

FIG. 1 illustrates a one-piece, disposable surgical mask and cap 10 according to one embodiment of our invention. The surgical mask and cap 10 is formed of a substantially rectangular blank 12 with an eye opening 14 formed therethrough. The blank 12 may be formed of conventional sterilizable material such as sterilized paper or the like which is cost-effective, disposable, biodegradable and sufficiently sturdy and comfortable for use as a surgical mask and cap. Such materials are well known to those of ordinary skill in the art. Additionally, the eye opening 14 may be formed rectangular, as shown, or in other conventional shapes such as ovals or the like. Elastic bands 16 may be attached to the blank 12, such as by adhesive or sewing or the like, surrounding the eye opening 14 to further secure the surgical mask and cap 10 to the user when worn. Additional elastic bands (not shown) may be provided at other positions in the surgical mask and cap 10. For example, elastic bands may be provided at portions of the periphery of the rectangular blank 12 to help secure the surgical mask and cap 10 to the user.

The upper portion 12A of the rectangular blank 12 above the eye opening 14 forms the cap portion of the surgical mask and cap 10. The lower portion 12B of the blank 12 positioned below the eye opening 14 forms the mask portion of the surgical mask and cap 10. Connecting portions 12C on opposite sides of the eye opening 14 connect the upper portion 12A to the lower portion 12B of the blank 12 to maintain an integral arrangement for the blank 12. A plurality of attachment straps 18 is attached to and extends off the side of the blank 12. Specifically, the straps 18 would be positioned extending off the lower portion 12B and, possibly, the connecting portion 12C of the blank 12.

In operation, the user places the mask and cap 10 on by appropriately aligning the eye opening 14 and allowing the upper portion 12A to extend from the user's eyes over the hair and adjacent head areas forming the cap portion of the surgical mask and cap 10. The lower portion 12B will cover the nose and mouth to filter the user's breathing. The surgical mask and cap 10 will be secured to the user by tying opposed pairs of straps 18 together behind the user's head and behind the upper portion 12A of the blank 12.

Figure 2:
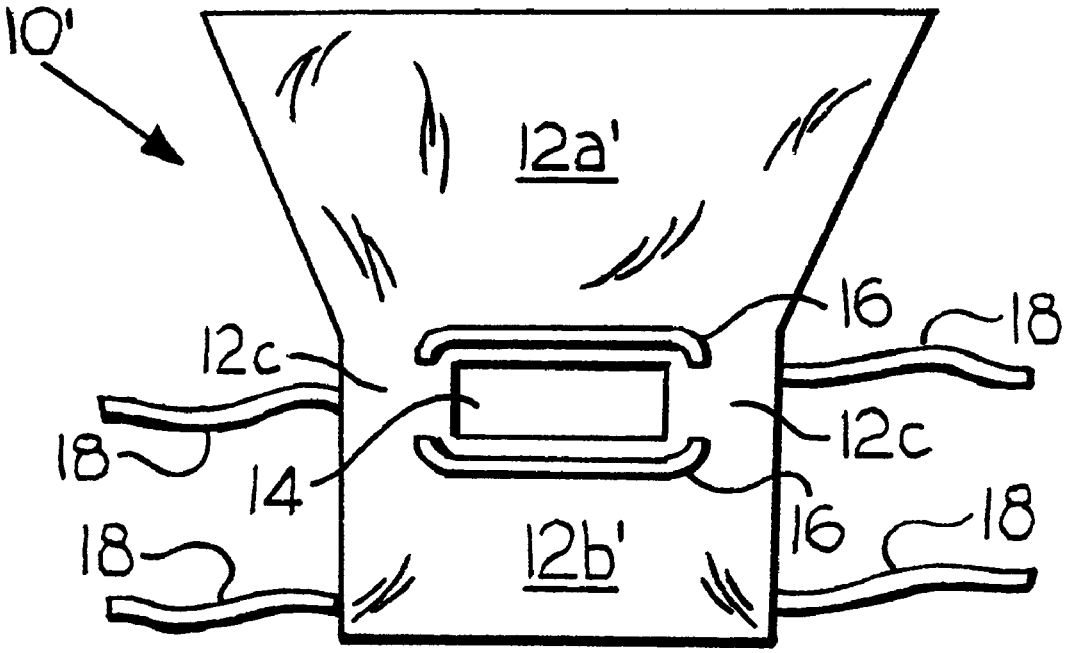
FIG. 2 is a plan view of a modified one-piece surgical mask and cap combination according to a second embodiment of our invention.

FIG. 2 illustrates a modified surgical mask and cap 10' according to our invention. The modified surgical mask and cap 10' is similar to the surgical mask and cap 10, described above and includes a substantially planar or flat blank 12' with an eye opening 14 therethrough. The blank 12' includes an upper portion 12A' forming the cap portion of the modified surgical mask and cap 10', a lower portion 12B below the eye opening forming the mask portion of the modified surgical mask and cap 10' and connecting portions 12C on opposite sides of the eye opening 14 connecting the upper portion 12A' to the lower portion 12B of the blank 12'. Elastic band 16 may be attached to blank 12' surrounding the eye opening 14. Furthermore, straps 18 extending from the sides of the blank 12' are substantially the same as described above in connection with surgical mask and cap 10. The modified surgical mask and cap 10' differs from surgical mask and cap 10 by the formation of the upper portion 12A' of the blank 12'. The side edges of the upper portion 12A' taper outwardly from connecting portion 12C of blank 12 to form a wider cap portion relative to the mask portion formed by the lower portion 12B. The modified surgical mask and cap 10' is designed to more completely cover the user's hair and associated head portions.

Figure 3:
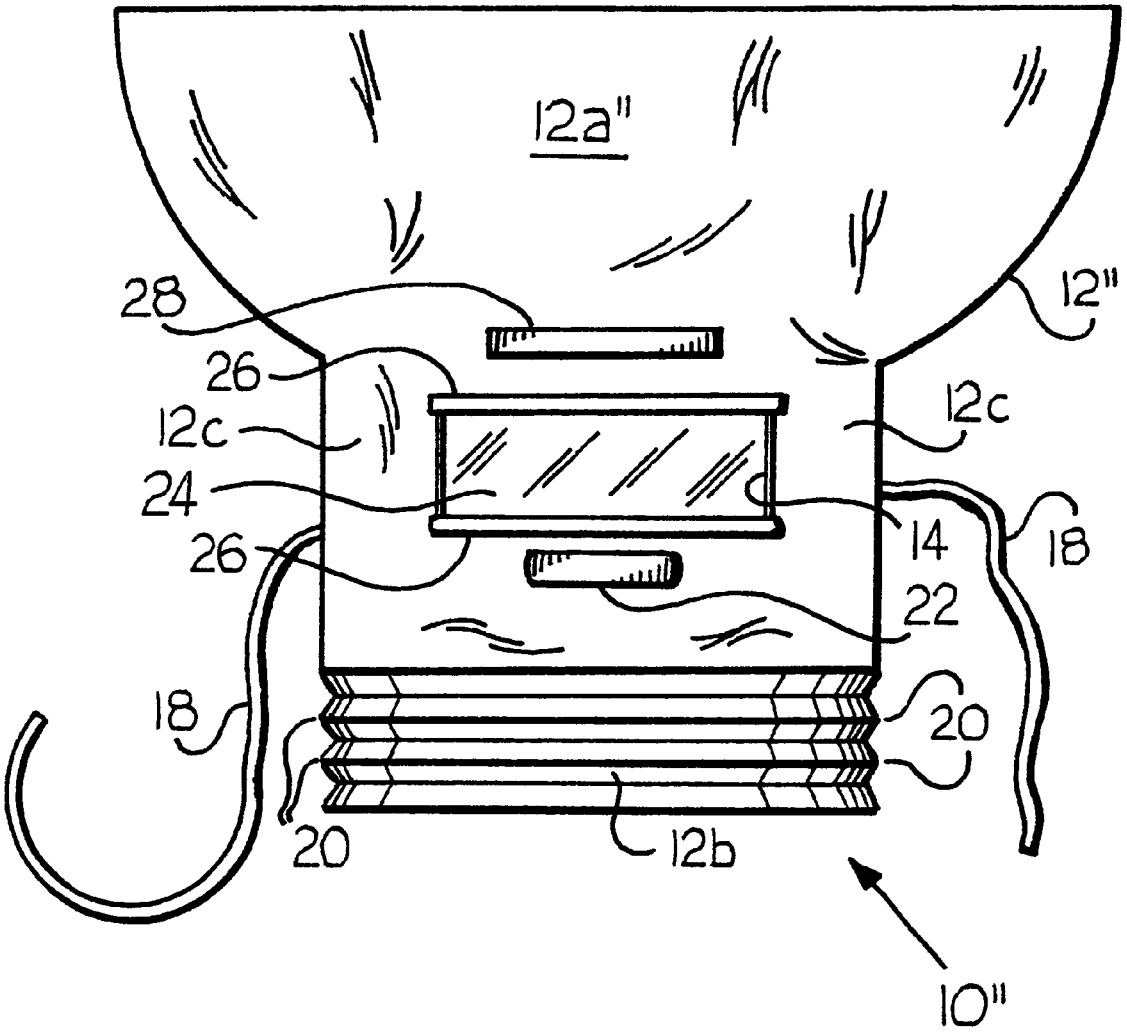
FIG. 3 is a plan view of a further modified one-piece surgical mask and cap combination according to a third embodiment of our invention.

FIG. 3 illustrates a further modified surgical mask and cap 10" according to our invention. The surgical mask and cap 10" is similar to the surgical mask and caps 10 and 10', described above, and includes a substantially planar or flat blank 12" with an eye opening 14 formed therethrough. The blank 12" includes an upper portion 12A" forming the cap portion of the surgical mask and cap 10", a lower portion 12B" below the eye opening 14 forming the mask portion of the surgical mask and cap 10", and connecting portions 12C on opposite sides of the eye opening 14 connecting the upper portion 12A" to the lower portion 12B" of the blank 12". A single set of straps 18 extend from the sides of the blank 12". This differs from mask and caps 10 and 10' illustrating that a different number of straps 18 can be utilized with the mask and caps 10, 10' and 10" according to our invention.

The surgical mask and cap 10" further differs from the surgical mask and cap 10 of FIG. 1 by the formation of the upper portion 12A" of the blank 12". The side edges of the upper portion 12A" are curved, or contoured, to expand outwardly, analogous to the tapered edges of the upper portion 12A' of the mask and cap 10', described above. This construction forms a wider cap portion relative to the mask portion formed by the lower portion 12B". Similar to the surgical mask and cap 10', this arrangement for the surgical mask and cap 10" is designed to more completely cover the user's hair and associated head portions as well as to better conform to the user's head. It should be apparent that other specific configurations could be considered within the scope of our invention to more easily conform the one-piece mask and cap to the user when in the operative position.

The lower portion 12B" of the mask and cap 10" differs from the lower portion 12B of the mask and caps 10 and 10' above by including a plurality of accordion type folds 20 on a lower portion thereof. The provision of the accordion folds 20 in the lower portion 12B" is intended to more easily form a pouch for receiving and conforming to the chin and mouth of the user. An additional feature for improving the conformance of the mask and cap 10' to the user is the inclusion of a nose piece 22 in the form of a deformable metal strip which is attached to the lower portion 12B of the blank 12" below the eye opening 14. The nose piece 22 can be attached to the blank 12" by adhesives or the like. In operation, the nose piece 22 is bent, slightly, around the nose of the user to help conform the mask and cap 10" to the user and help position the mask and cap 10" appropriately.

Additionally, an eye shield 24 is positioned over the eye opening 14 to provide more protection for the user. The eye shield 24 can be formed of glass or flexible plastic or any other appropriate see-through material. The eye shield 24 may be attached to the blank 12 in any conventional fashion, such as for example, being removably attached by sliding engagements within two channels 26 positioned on opposite sides of the eye opening 14. The channel 26 can be glued or otherwise attached to the blank 12' in any conventional fashion. With the eye shield 24 removably attached or positioned in the mask and cap 10", the eye shield 24 may be formed as a corrective lens specific to the individual user. In this arrangement, a corrective lens forming the eye shield 24 can be slid into the channels 26 of a specific mask and cap 10" and then, subsequent to the operation or use, be removed therefrom, sterilized and inserted into a subsequent mask and cap 10".

The mask and cap 10" illustrated in FIG. 3 also includes a perspiration absorbent pad 28 positioned above the eye opening 14 for the comfort of the user. Perspiration absorbent pad 28 can be attached by adhesives or other known mechanisms to the blank 12" and may be located at other locations as desired. As with the surgical mask and caps 10 and 10', discussed above, elastic material may be attached at various locations to better conform the mask and cap 10" to the user. The mask and cap 10" operates substantially the same as the mask and cap 10 and 10', discussed above, with the inclusion of the additional features described herein.

The surgical mask and caps 10, 10' and 10" provide a greatly simplified construction over the prior art one-piece designs. The simplified, substantially planar configuration of the surgical mask and caps 10, 10' and 10" greatly facilitates the manufacture, storage, shipping and operation of our invention. The simplified construction of the mask and caps 10, 10' and 10" are easy to position by the user and provide complete coverage while accommodating long hair of a user. Additionally, the one-piece mask and caps 10, 10' and 10" improve hygiene over existing two-piece structures by assuring that both the cap and mask will be changed with each replacement.

It will be apparent to those of ordinary skill in the art that various modifications may be made to the present invention without departing from the spirit and scope thereof.

We claim:

1. A one-piece, disposable surgical mask and cap formed of a substantially planar blank with an eye opening formed therethrough, and including at least one strap extending from a side of said substantially planar blank adapted to secure said one-piece surgical mask and cap to a user, wherein a portion of said blank above said eye opening forms a cap portion, a portion of said blank below said eye opening forms a mask portion, and wherein said mask portion and cap portion of said blank are attached to each other by connecting portions of said blank on opposite sides of said eye opening, and further including a nose piece attached to said blank, said nose piece formed of a deformable metal strip.

2. The one-piece surgical mask and cap of claim 1 wherein said blank is a substantially rectangular blank.

3. The one-piece surgical mask and cap of claim 1 wherein said cap portion is wider than said mask portion.

4. The one-piece surgical mask and cap of claim 1 further including a plurality of accordion type folds in said mask portion adapted to form a pouch for receiving the chin and mouth of a user.

5. The one-piece surgical mask and cap of claim 1 wherein side edges of said cap portion expand outwardly in a direction extending away from said mask portion.

6. The one-piece surgical mask and cap of claim 1 further including elastic material attached to said blank, said elastic material adapted to conform said one-piece surgical mask and cap to a user.

7. The one-piece surgical mask and cap of claim 1 further including at least one perspiration absorbent pad attached to said blank.

8. The one-piece surgical mask and cap of claim 1 further including an eye shield attached to said blank covering said eye opening.

9. A one-piece, disposable surgical mask and cap formed of a substantially planar blank with an eye opening formed therethrough, and including at least one strap extending from a side of said substantially planar blank adapted to secure said one-piece surgical mask and cap to a user, wherein a portion of said blank above said eye opening forms a cap portion, a portion of said blank below said eye opening forms a mask portion, and wherein said mask portion and cap portion of said blank are attached to each other by connecting portions of said blank on opposite sides of said eye opening, further including an eye shield attached to said blank covering said eye opening.

10. The one-piece surgical mask and cap of claim 9 wherein said eye shield is removably attached to said blank.

11. The one-piece surgical mask and cap of claim 10 wherein said eye shield is formed as a corrective lens which is removably attached to said blank.

12. A one-piece surgical mask and cap of claim 9 wherein said blank is a substantially rectangular blank.

13. The one-piece surgical mask and cap of claim 9, wherein said cap portion is wider than said mask portion.

14. The one-piece surgical mask and cap of claim 9 further including a plurality of accordion type folds in said mask portion to form a pouch for receiving the chin and mouth of a user.

15. The one-piece surgical mask and cap of claim 9 wherein side edges of said cap portion expand outwardly in a direction extending away from said mask portion.

16. The one-piece surgical mask and cap of claim 9 further including elastic material attached to said blank, said elastic material adapted to conform said one-piece surgical mask and cap to a user.

17. The one-piece surgical mask and cap of claim 9 further including at least one perspiration pad attached to said blank.

18. The one-piece surgical mask and cap of claim 9 further including a nose piece attached to said blank, said nose piece formed of a deformable metal strip.

* * * * *